US012546047B2

(12) United States Patent
Latham et al.

(10) Patent No.: US 12,546,047 B2
(45) Date of Patent: Feb. 10, 2026

(54) WASHING MACHINE APPLIANCE LOAD TYPE DETECTION

(71) Applicant: Haier US Appliance Solutions, Inc., Wilmington, DE (US)

(72) Inventors: Joseph Wilson Latham, Louisville, KY (US); Michael Lee McIntyre, Louisville, KY (US); Noah Damron, Knoxville, TN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 215 days.

(21) Appl. No.: 18/447,198

(22) Filed: Aug. 9, 2023

(65) Prior Publication Data

US 2025/0051988 A1 Feb. 13, 2025

(51) Int. Cl.

| | |
|---|---|
| ***D06F 34/18*** | (2020.01) |
| ***D06F 23/04*** | (2006.01) |
| ***D06F 33/40*** | (2020.01) |
| ***D06F 33/42*** | (2020.01) |
| ***D06F 34/22*** | (2020.01) |
| *D06F 103/06* | (2020.01) |
| *D06F 103/18* | (2020.01) |
| *D06F 103/46* | (2020.01) |

(Continued)

(52) U.S. Cl.

CPC ..... *D06F 34/18* (2020.02); *D06F 23/04* (2013.01); *D06F 33/40* (2020.02); *D06F 33/42* (2020.02); *D06F 34/22* (2020.02); *D06F 2103/06* (2020.02); *D06F 2103/18* (2020.02); *D06F 2103/46* (2020.02); *D06F 2105/08* (2020.02); *D06F 2105/48* (2020.02)

(58) Field of Classification Search

CPC ..... D06F 33/40; D06F 33/42; D06F 33/47; D06F 34/18; D06F 34/22; D06F 2103/02; D06F 2103/06; D06F 2103/18; D06F 2103/46; D06F 2105/08; D06F 2105/48; D06F 2105/52

See application file for complete search history.

(56) References Cited

U.S. PATENT DOCUMENTS

| | | | |
|---|---|---|---|
| 8,872,463 | B2 | 10/2014 | Sonoda et al. |
| 9,096,964 | B2 | 8/2015 | Albayrak et al. |
| 9,890,492 | B2 | 2/2018 | Melo et al. |

(Continued)

FOREIGN PATENT DOCUMENTS

| | | |
|---|---|---|
| EP | 1113102 B1 | 7/2003 |

*Primary Examiner* — David G Cormier
(74) *Attorney, Agent, or Firm* — Dority & Manning, P.A.

(57) ABSTRACT

A washing machine appliance includes a tub, a rotatable basket within the tub, and an annulus defined between the tub and the basket. A method of operating the washing machine appliance includes activating a drain pump to remove standing wash liquid from the annulus. The method also includes deactivating the drain pump after removing the standing wash liquid and rotating the basket within the wash tub for a first time period after deactivating the drain pump. The drain pump remains deactivated during the first time period. The method further includes determining a level of wash liquid in the annulus after rotating the basket within the wash tub for the first time period and determining a load type of the load of articles based on the level of wash liquid in the annulus after rotating the basket within the wash tub for the first time period.

20 Claims, 3 Drawing Sheets

(51) Int. Cl.
*D06F 105/08* (2020.01)
*D06F 105/48* (2020.01)

(56) References Cited

U.S. PATENT DOCUMENTS

| | | | | |
|---|---|---|---|---|
| 2008/0178398 | A1 | 7/2008 | Darby et al. | |
| 2020/0308749 | A1* | 10/2020 | Ohyagi | D06F 39/08 |
| 2021/0340701 | A1 | 11/2021 | Bae | |
| 2022/0356625 | A1 | 11/2022 | Scheckelhoff et al. | |

* cited by examiner

WASHING MACHINE APPLIANCE LOAD TYPE DETECTION

FIELD OF THE INVENTION

The present subject matter relates generally to washing machine appliances and methods for operating washing machine appliances, and more particularly to systems and methods for detecting a non-shedding load of articles in such appliances.

BACKGROUND OF THE INVENTION

Washing machine appliances generally include a tub for containing wash liquid, e.g., water, detergent, and/or bleach, during operation of such washing machine appliances. A basket is rotatably mounted within the tub and defines a wash chamber for receipt of articles for washing. During operation of such washing machine appliances, wash liquid is directed into the tub and onto articles within the wash chamber of the basket. The basket can rotate at various speeds to agitate articles within the wash chamber in the wash liquid, to wring wash liquid from articles within the wash chamber, etc. Washing machine appliances include vertical axis washing machine appliances and horizontal axis washing machine appliances, where "vertical axis" and "horizontal axis" refer to the axis of rotation of the wash basket within the wash tub.

A concern during operation of washing machine appliances is the balance of the basket and contents thereof, e.g., a load of articles and wash liquid, during operation. For example, the articles and wash liquid within the basket may not be equally weighted about a central axis of the basket and tub. Accordingly, when the basket rotates, in particular during a spin cycle, the imbalance in weight may cause the basket to be out-of-balance within the tub, such that the axis of rotation does not align with the central axis of the basket or tub. Such out-of-balance issues during rotation of the basket can cause excessive noise, vibration or motion, or other undesired conditions.

Further, a type of the load of articles, e.g., a material type and the absorbency of the material of the articles, may influence the behavior of the articles and wash liquid during the spin cycle. In particular, when the load includes one or more non-shedding articles, e.g., articles which are waterproof or very low water absorbency, wash liquid may be retained within the basket up to a certain rotational speed (such as entrapped within folds of a non-shedding article) and then, as the rotation accelerates, the wash liquid may be rapidly displaced within or from the basket, causing a sudden shift in the center of mass of the contents of the basket. Such shifting of the center of mass may result in an increased likelihood of an out-of-balance condition. Additionally, such shifting may result in a sudden or rapid out-of-balance condition, which may cause significant out-of-balance issues before remediation, e.g., redistributing the load of articles or slowing the rotational speed, can be effected.

Accordingly, a laundry appliance having improved features for determining whether a load of articles therein includes non-shedding articles would be desired.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a washing machine appliance is provided. The washing machine appliance includes a wash tub mounted within the washing machine appliance and a basket rotatably mounted within the wash tub such that an annulus is defined outside of the basket and within the wash tub. The method includes activating a drain pump to remove standing wash liquid from the annulus. The method also includes deactivating the drain pump after removing the standing wash liquid and rotating the basket within the wash tub for a first time period after deactivating the drain pump. The drain pump remains deactivated during the first time period. The method further includes determining a level of wash liquid in the annulus after rotating the basket within the wash tub for the first time period and determining a load type of the load of articles based on the level of wash liquid in the annulus after rotating the basket within the wash tub for the first time period.

In another aspect of the present disclosure, a washing machine appliance is provided. The washing machine appliance includes a wash tub mounted within the washing machine appliance and a basket rotatably mounted within the wash tub such that an annulus is defined outside of the basket and within the wash tub. The washing machine appliance also includes a controller. The controller is configured for activating a drain pump to remove standing wash liquid from the annulus. The controller is also configured for deactivating the drain pump after removing the standing wash liquid and for rotating the basket within the wash tub for a first time period after deactivating the drain pump. The drain pump remains deactivated during the first time period. The controller is further configured for determining a level of wash liquid in the annulus after rotating the basket within the wash tub for the first time period and determining a load type of the load of articles based on the level of wash liquid in the annulus after rotating the basket within the wash tub for the first time period.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
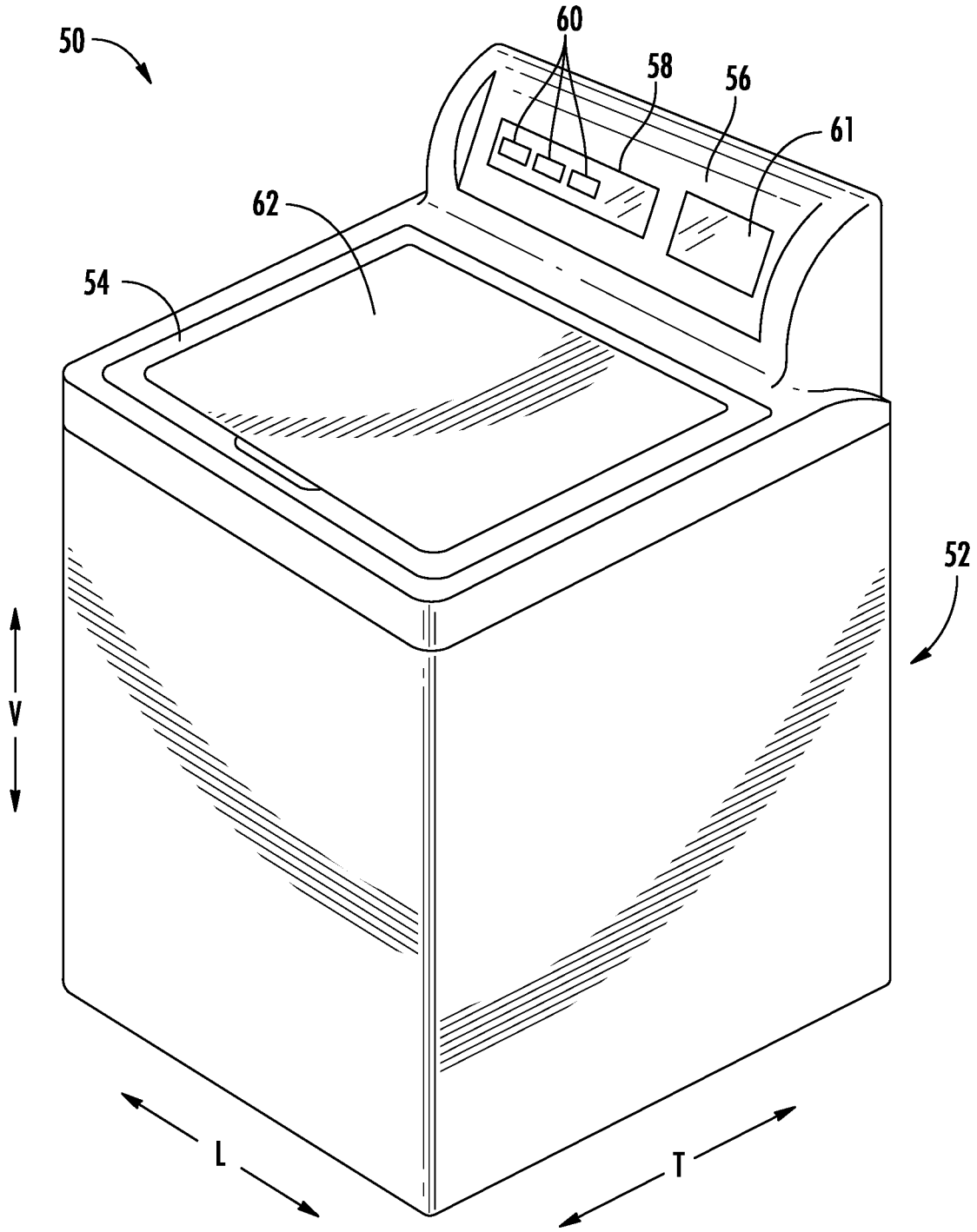
FIG. 1 provides a perspective view of a washing machine appliance according to one or more exemplary embodiments of the present subject matter.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As illustrated, washing machine appliance 50 generally defines a vertical direction V, a lateral direction L. and a transverse direction T, each of which is mutually perpendicular, such that an orthogonal coordinate system is generally defined. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
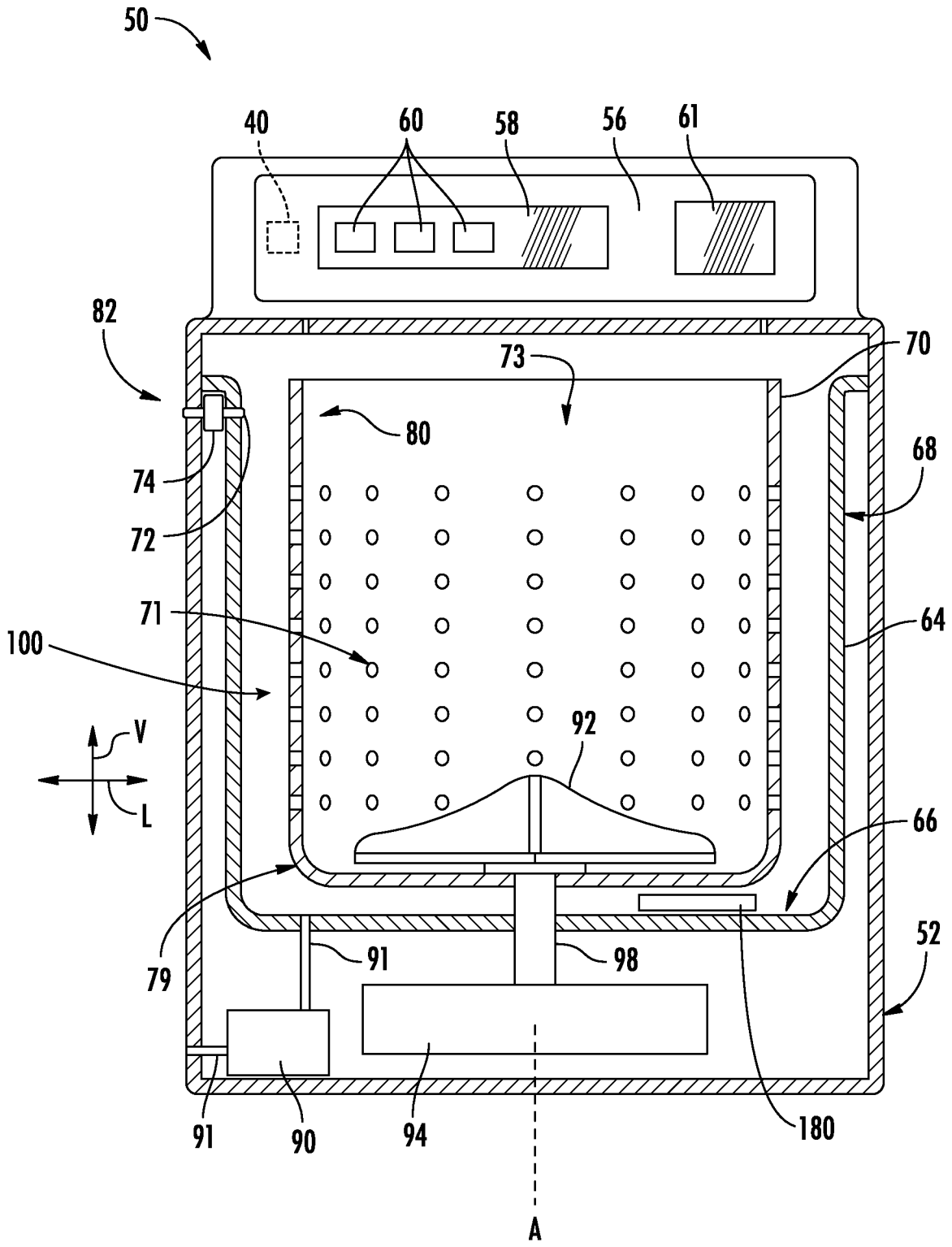
FIG. 2 provides a front, section view of the exemplary washing machine appliance of FIG. 1.

FIG. 2 provides a front, cross-section view of washing machine appliance 50. As may be seen in FIG. 2, wash tub 64 includes a bottom wall 66 and a sidewall 68. A wash basket 70 is rotatably mounted within wash tub 64. The wash basket 70 is positioned and oriented within the wash tub 64 such that an annulus 100 is defined between the wash basket 70 and the wash tub 64, e.g., the annulus 100 may be the portion of the wash tub 64 outside of the wash basket 70, e.g., the annulus 100 may be defined outside of the basket 70 and within the wash tub 64. In some embodiments, wash basket 70 is rotatable about an axis of rotation A which, in the illustrated embodiment of FIGS. 1 and 2, is generally parallel to the vertical direction V. Thus, washing machine appliance 50 may be referred to as a vertical axis washing machine appliance. Wash basket 70 defines a wash chamber 73 for receipt of articles for washing and extends, e.g., vertically, between a bottom portion 79 and a top portion 80. Wash basket 70 includes a plurality of perforations 71 therein to facilitate fluid communication between an interior of wash basket 70 and wash tub 64.

A spout 72 is configured for directing a flow of fluid into wash tub 64. In particular, spout 72 may be positioned at or adjacent top portion 80 of wash basket 70. Spout 72 may be in fluid communication with a water supply (not shown) in order to direct fluid (e.g., clean water) into wash tub 64 and/or onto articles within wash chamber 73 of wash basket 70. A valve 74 regulates the flow of fluid through spout 72. For example, valve 74 can selectively adjust to a closed position in order to terminate or obstruct the flow of fluid through spout 72. A pump assembly 90 (shown schematically in FIG. 2) is located beneath tub 64 and wash basket 70 for gravity assisted flow from wash tub 64. Pump 90 may be positioned along or in operative communication with a drain line 91 which provides fluid communication from the wash chamber 73 of the basket 70 to an external conduit, such as a wastewater line (not shown). In some embodiments, the pump 90 may also or instead be positioned along or in operative communication with a recirculation line (not shown) which extends back to the tub 64, e.g., in addition to the drain line 91.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitation element 92 is oriented to rotate about axis of rotation A. In the illustrated example embodiment, wash basket 70 and agitation element 92 are driven by a pancake motor 94. As motor output shaft 98 is rotated, wash basket 70 and agitation element 92 are operated for rotatable movement within wash tub 64, e.g., about the axis of rotation A. Washing machine appliance 50 may also include a brake assembly (not shown) selectively applied or released for respectively maintaining wash basket 70 in a stationary position within wash tub 64 or for allowing wash basket 70 to spin within wash tub 64. Additionally, the illustrated drive system, e.g., motor 94 and motor output shaft 98, is provided by way of example only and the drive system of the washing machine appliance may include various configurations within the scope of the present disclosure, such as different motor types and sizes, or the drive system may include a belt and a pulley system, among other possible variations.

Operation of washing machine appliance 50 is controlled by a processing device or controller 40 that is operatively coupled to the user interface input located on washing machine backsplash 56 for user manipulation to select washing machine cycles and features. In response to user manipulation of the user interface input, controller 40 operates the various components of washing machine appliance 50 to execute selected machine cycles and features.

Controller 40 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 40 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 40 via one or more signal lines or shared communication busses. In particular, controller 40 may be communicatively coupled with one or more sensors, e.g., pressure sensor 180 (FIG. 2), a temperature sensor, and/or other sensors or measurement devices.

In an illustrative embodiment, laundry items are loaded into wash chamber 73 of wash basket 70, and washing operation is initiated through operator manipulation of control input selectors 60. Wash tub 64 is filled with water and mixed with detergent to form a wash liquid. The term "wash liquid" as used herein may include water alone or in combination with one or more additives such as laundry treatment agents, detergent, etc., or the "wash liquid" may not include water. Valve 74 can be opened to initiate a flow of water into wash tub 64 via spout 72, and wash tub 64 can be filled to the appropriate level for the amount of articles being washed. Once wash tub 64 is properly filled with wash liquid, the contents of the wash basket 70 are agitated with agitation element 92 for cleaning of laundry items in wash basket 70. More specifically, agitation element 92 is moved back and forth in an oscillatory motion. The wash liquid may be recirculated through the washing machine appliance 50 at various points in the wash cycle, such as before or during the agitation phase (as well as one or more other portions of the wash cycle, separately or in addition to before and/or during the agitation phase).

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash liquid from the articles being washed. During a spin cycle, wash basket 70 is rotated at relatively high speeds. In various embodiments, the pump 90 may be activated to drain liquid from the washing machine appliance 50 during the entire drain phase (or the entirety of each drain phase, e.g., between the wash and rinse and/or between the rinse and the spin) and may be activated during one or more portions of the spin cycle.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features (such as different drive systems) may also be utilized with the present subject matter as well.

Figure 3:
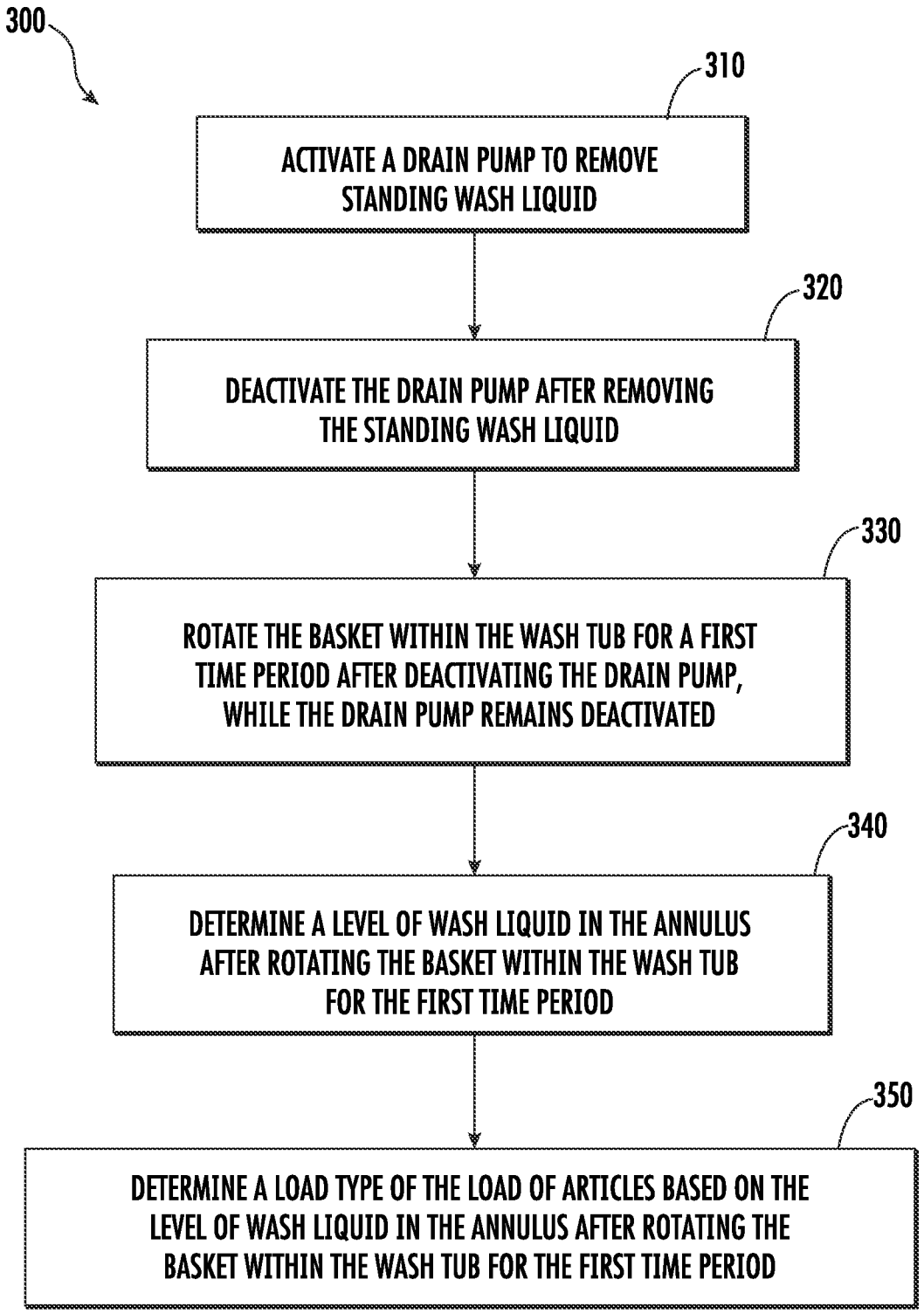
FIG. 3 provides a flow chart illustrating a method for operating a washing machine appliance in accordance with one or more exemplary embodiments of the present disclosure.

Turning now to FIG. 3, embodiments of the present disclosure may also include methods of operating a washing machine appliance, such as the example method 300 illustrated in FIG. 3. Such methods may be used with any suitable washing machine appliance, such as washing machine appliance 50, as described above.

For example, as mentioned above, the washing machine appliance 50 may include a controller 40 and the controller 40 may be operable for, e.g., configured for, performing some or all of the methods and/or steps thereof described herein. For example, one or more method steps may be embodied as an algorithm or program stored in a memory of the controller 40 and executed by the controller 40 in response to a user input such as a selection of a wash operation or rinse operation, etc., of the washing machine appliance 50.

As mentioned, method 300 may be used with any suitable washing machine appliance, such as a washing machine appliance which includes a wash tub mounted within the washing machine appliance and a basket rotatably mounted within the wash tub whereby an annulus is defined outside of the basket and within the wash tub. As illustrated in FIG. 3, in some embodiments, the method 300 may include a step 310 of activating a drain pump to remove standing wash liquid from the tub, such as from the annulus of the tub, e.g., around and/or below the wash basket. The standing wash liquid may be present in the annulus, e.g., after an agitation phase or agitation portion, such as the exemplary agitation phase described above.

Method 300 may then include deactivating the drain pump after removing the standing wash liquid, e.g., as indicated at 320 in FIG. 3, and rotating the basket within the wash tub for a first time period after deactivating the drain pump. Further, the drain pump may remain deactivated during the first time period. In some embodiments, rotating the basket within the wash tub for the first time period may include rotating the basket at a speed greater than a minimum extraction speed, such that wash liquid within the basket may be removed from the basket during the rotation, and, where the drain pump is off during the first time period, such wash liquid may thusly be retained within the tub outside of the basket, e.g., in the annulus.

Moreover, those of ordinary skill in the art will recognize that there may be a range of effective water extraction speeds, such as a range of rotational speeds of the basket which may be effective to centrifugally extract at least a portion of the moisture from the basket and/or articles therein while rotating the basket. Thus, for example, methods of operating the washing machine appliance may include multiple differing extraction speeds, such as in an inclusive range from a minimum water extraction speed to a maximum water extraction speed. For example, the rotation speed may be greater than the minimum extraction speed and less than a plaster speed or less than a maximum extraction speed, e.g., where an out-of-balance condition is more likely to occur at or above the plaster speed or maximum extraction speed.

In particular, where method 300 may be used to detect a potential out-of-balance condition or a load, such as a non-shedding load, which may be more susceptible to an out-of-balance condition, rotating the basket at step 330 may include speeds which are limited, e.g., less than maximum water extraction speed, in order to reduce the likelihood of an out-of-balance condition during the method 300. For example, rotating the basket may include rotating the basket at a speed greater than the minimum water extraction speed and less than the maximum water extraction speed and/or less than a full terminal speed, where the full terminal speed is a full terminal speed of the overall cycle of the washing machine appliance, e.g., the full terminal speed may be the default, e.g., predetermined or pre-programmed, maximum speed for a spin operation of the overall cycle, such as a largest parametric value for a spin speed operating parameter stored in a memory of a controller of the washing machine appliance, or the largest parametric value may also or instead be stored remotely, e.g., in the cloud or other distributed computing environment.

The first time period may be at least long enough for the drive system of the washing machine appliance to reach steady-state operation, e.g., in some embodiments, the rotation of the basket may reach steady-state operation during the first time period. For example, the drive system may include a motor which is operable to drive the rotation of the basket. To reach steady-state operation, the motor may start from a zero speed and overcomes forces which tend to keep the basket stationary, such as inertia and friction, in order to build up rotational speed of the basket until the rotational speed reaches a generally constant, steady-state, speed.

Method 300 may further include determining a level of wash liquid in the annulus after rotating the basket within the wash tub for the first time period, e.g., as illustrated at 340 in FIG. 3. In embodiments where the rotation speed during the first time period is greater than the minimum extraction speed, then some wash liquid would be expected to be present in the tub, such as in the annulus of the tub (e.g., in the tub and outside of the basket) after rotating the basket during the first time period. However, the level of wash liquid may be less than expected, e.g., less than a predetermined threshold level, where the predetermined threshold level may be based on a load size, load type, fill volume of the current wash cycle, and/or other factors and characteristics of the wash load and/or wash cycle, when the load is a non-shedding load. For example, a level of wash liquid in the annulus after rotating the basket for the first time period that is below the predetermined threshold may indicate that wash liquid is trapped in the basket, such as by one or more non-shedding articles.

Accordingly, as shown at 350 in FIG. 3, method 300 may further include determining a load type of the load of articles based on the level of wash liquid in the annulus after rotating the basket within the wash tub for the first time period. For example, determining the load type may include determining whether the load is a non-shedding load. Determining the load type may include, e.g., determining a shedding load or normal load when a certain amount (e.g., above a predetermined threshold) of wash liquid is present in the annulus or determining a non-shedding load when the level of wash liquid is less than the predetermined threshold.

In some embodiments, the level of wash liquid may be determined by measuring the level of wash liquid in the annulus with a pressure sensor. In other embodiments, the level of wash liquid may be determined more indirectly, such as by measuring a system variable of the washing machine appliance.

For example, in some embodiments, the level of wash liquid may be determined by analyzing a drive system variable. Such embodiments may include activating the drain pump after the first time period and rotating the basket within the wash tub for a second time period after activating the drain pump. Thus, activating the drain pump after the first time period would remove or reduce any wash liquid from the annulus which accumulated therein during the first time period (while the drain pump was off during the first time period), such that the drag on the basket due to wash liquid (if any) present in the annulus is also removed or reduced.

Accordingly, exemplary methods according the present disclosure may also include monitoring a drive system variable of the washing machine appliance during the first time period and the second time period, and comparing the drive system variable during the first time period with the drive system variable during the second time period. The second time period may be approximately the same length of time as the first time period, or may be less than the first time period. In some embodiments, the second time period may be at least long enough for the rotation of the basket to reach steady-state operation, e.g., in a similar manner as described above with respect to the first time period. The basket may be rotated at approximately the same speed, or the drive system may otherwise be operated at approximately the same level, e.g., same current, voltage, or power supplied, during the second time period as during the first time period.

The drive system variable may differ, e.g., decrease, from the first time period to the second time period when the level of wash liquid was reduced by running the drain pump after the first time period, thereby reducing the drag on the basket as mentioned. Thus, the level of wash liquid in the annulus after the first time period may be inferred or determined from the drive system response to activating the drain pump following the first time period. In such embodiments, determining the level of wash liquid in the annulus may include determining the level of wash liquid in the annulus based on the comparison of the drive system variable during the first time period with the drive system variable during the second time period.

Any suitable drive system variable which relates to or represents the amount of work done by the drive system when rotating the basket during the first and second time periods may be used to determine the level of wash liquid in the annulus at the end of the first time period and thus the potential presence of a non-shedding load, and the particular variable or variables selected may relate to the type of drive system provided in the washing machine appliance. For example, in some embodiments, the drive system variable may include a motor torque of a motor of the drive system or a current drawn by a motor of the drive system. In additional embodiments, the drive system variable may also or instead include a voltage provided to the motor during the first and second time periods or other electrical variable, e.g., power, or a speed of the motor and/or basket, among other possible drive system variables. In general, the presence or absence of wash liquid in the annulus after rotating the basket for the first time period may be determined by looking for a change, e.g., decrease, in the drive system variable while rotating the basket before and after activating the drain pump.

The load detection method may be performed as a part of an overall cycle of the washing machine appliance. For example, in some embodiments, the load detection may be performed after an agitation portion of the wash cycle, e.g., activating the drain pump to remove standing wash liquid from the annulus may be performed during the wash cycle and after the agitate portion of the wash cycle.

In exemplary embodiments where the load is determined to be a non-shedding load, e.g., where determining the load type of the load of articles includes determining the load of articles is a non-shedding load, the method 300 may further include one or more remedial actions in order to reduce the likelihood of an out-of-balance condition occurring while washing the non-shedding load. For example, in some embodiments, such remedial actions may include limiting a final spin speed in response to determining the load of articles is a non-shedding load, such as performing a spin operation, e.g., wherein the terminal speed of the spin operation is less than the full terminal speed and/or less than a maximum water extraction speed. As another example, such remedial actions may also or instead include performing a load redistribution operation in response to determining the load of articles is a non-shedding load. The load redistribution operation may include rotating the basket and/or an agitator therein, such as oscillating one or both of the basket and agitator back and forth, at a tumble speed (e.g., less than water extraction speed, as will be understood by those of ordinary skill in the art), and may also include draining the wash tub and re-filling the wash tub with a second volume of water. For example, the load redistribution operation may free any water trapped in the folds of the non-shedding articles and promote balancing the load.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a wash tub mounted within the washing machine appliance and a basket rotatably mounted within the wash tub whereby an annulus is defined outside of the basket and within the wash tub, the method comprising:

activating a drain pump to remove standing wash liquid from the annulus;

deactivating the drain pump after removing the standing wash liquid;

rotating the basket within the wash tub for a first time period after deactivating the drain pump, wherein the drain pump remains deactivated during the first time period;

determining a level of wash liquid in the annulus after rotating the basket within the wash tub for the first time period; and determining a load type of the load of articles based on the level of wash liquid in the annulus after rotating the basket within the wash tub for the first time period.

2. The method of claim 1, determining the level of wash liquid in the annulus after rotating the basket within the wash tub for the first time period comprises measuring the level of wash liquid in the annulus with a pressure sensor.

3. The method of claim 1, further comprising activating the drain pump after the first time period, rotating the basket within the wash tub for a second time period after activating the drain pump after the first time period, monitoring a drive system variable of the washing machine appliance during the first time period and the second time period, and comparing the drive system variable during the first time period with the drive system variable during the second time period, wherein determining the level of wash liquid in the annulus comprises determining the level of wash liquid in the annulus based on the comparison of the drive system variable during the first time period with the drive system variable during the second time period.

4. The method of claim 3, wherein the drive system variable comprises a voltage provided to a motor of the drive system.

5. The method of claim 3, wherein the drive system variable comprises a current drawn by a motor of the drive system.

6. The method of claim 1, wherein the rotation of the basket reaches steady-state operation during the first time period.

7. The method of claim 1, wherein rotating the basket within the wash tub for the first time period comprises rotating the basket at a speed greater than a minimum extraction speed and less than a plaster speed.

8. The method of claim 1, wherein activating the drain pump to remove standing wash liquid from the annulus is performed during a wash cycle after an agitate portion of the wash cycle.

9. The method of claim 1, wherein determining the load type of the load of articles comprises determining the load of articles is a non-shedding load.

10. The method of claim 9, further comprising limiting a final spin speed in response to determining the load of articles is a non-shedding load.

11. The method of claim 9, further comprising performing a load redistribution operation in response to determining the load of articles is a non-shedding load.

12. A washing machine appliance, comprising:

a wash tub mounted within the washing machine appliance;

a basket rotatably mounted within the wash tub whereby an annulus is defined outside of the basket and within the wash tub; and a controller, the controller configured for:

activating a drain pump to remove standing wash liquid from the annulus;

deactivating the drain pump after removing the standing wash liquid;

rotating the basket within the wash tub for a first time period after deactivating the drain pump, wherein the drain pump remains deactivated during the first time period;

determining a level of wash liquid in the annulus after rotating the basket within the wash tub for the first time period; and determining a load type of the load of articles based on the level of wash liquid in the annulus after rotating the basket within the wash tub for the first time period.

13. The washing machine appliance of claim 12, wherein determining the level of wash liquid in the annulus after rotating the basket within the wash tub for the first time period comprises measuring the level of wash liquid in the annulus with a pressure sensor.

14. The washing machine appliance of claim 12, wherein the controller is further configured for activating the drain pump after the first time period, rotating the basket within the wash tub for a second time period after activating the drain pump after the first time period, monitoring a drive system variable of the washing machine appliance during the first time period and the second time period, and comparing the drive system variable during the first time period with the drive system variable during the second time period, wherein determining the level of wash liquid in the annulus comprises determining the level of wash liquid in the annulus based on the comparison of the drive system variable during the first time period with the drive system variable during the second time period.

15. The washing machine appliance of claim 14, wherein the drive system variable comprises a voltage provided to a motor of the drive system.

16. The washing machine appliance of claim 14, wherein the drive system variable comprises a current drawn by a motor of the drive system.

17. The washing machine appliance of claim 12, wherein the rotation of the basket reaches steady-state operation during the first time period.

18. The washing machine appliance of claim 12, wherein rotating the basket within the wash tub for the first time period comprises rotating the basket at a speed greater than a minimum extraction speed and less than a plaster speed.

19. The washing machine appliance of claim 12, wherein activating the drain pump to remove standing wash liquid from the annulus is performed during a wash cycle after an agitate portion of the wash cycle.

20. The washing machine appliance of claim 12, wherein determining the load type of the load of articles comprises determining the load of articles is a non-shedding load, and wherein the controller is further configured for performing a load redistribution operation in response to determining the load of articles is a non-shedding load.

* * * * *